US007293317B2

(12) United States Patent
Tsuchiya et al.

(10) Patent No.: US 7,293,317 B2
(45) Date of Patent: Nov. 13, 2007

(54) HOLDING DEVICE AND CLEANING TOOL WITH THE HOLDING DEVICE

(75) Inventors: Akemi Tsuchiya, Kagawa (JP); Yoshinori Tanaka, Kawaga (JP); Masatoshi Fujiwara, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 100 days.

(21) Appl. No.: 11/012,949

(22) Filed: Dec. 14, 2004

(65) Prior Publication Data

US 2005/0102781 A1 May 19, 2005

Related U.S. Application Data

(63) Continuation of application No. PCT/JP2003/09156, filed on Jul. 18, 2003.

(30) Foreign Application Priority Data

Jul. 22, 2002 (JP) ..... 2002-212532

(51) Int. Cl.
*A47L 13/10* (2006.01)

(52) U.S. Cl. ..... 15/147.2; 15/144.1

(58) Field of Classification Search ..... 15/144.1, 15/172, 147.2; 294/53.5
See application file for complete search history.

(56) References Cited

U.S. PATENT DOCUMENTS

| | | | | |
|---|---|---|---|---|
| 261,894 | A * | 8/1882 | Albers | 294/53.5 |
| 357,408 | A * | 2/1887 | Pittenger | 294/53.5 |
| 612,491 | A * | 10/1898 | Eck | 15/111 |
| 881,782 | A * | 3/1908 | Elliot | 294/51 |
| 1,427,865 | A * | 9/1922 | Szabo | 294/53.5 |
| 1,570,189 | A * | 1/1926 | Sturm | 294/51 |
| 2,740,146 | A * | 4/1956 | Vaughn | 15/119.2 |
| 4,658,461 | A * | 4/1987 | Roe et al. | 15/210.1 |
| 5,110,230 | A * | 5/1992 | Cole et al. | 401/52 |
| 5,414,889 | A * | 5/1995 | Sartori | 15/159.1 |
| 5,960,509 | A * | 10/1999 | Wu | 15/244.2 |
| 6,315,341 | B1 * | 11/2001 | Leon et al. | 294/53.5 |

FOREIGN PATENT DOCUMENTS

| | | |
|---|---|---|
| JP | 51-85273 | 7/1976 |
| JP | 53-40271 | 10/1978 |
| JP | 09-038009 | 2/1997 |
| JP | 09-154791 | 6/1997 |
| JP | 10-043116 | 2/1998 |
| JP | 10-309251 | 11/1998 |
| JP | 3061057 | 6/1999 |
| JP | 2977477 | 9/1999 |
| JP | 2002-017640 | 1/2002 |
| JP | 2002-177186 | 6/2002 |

* cited by examiner

*Primary Examiner*—Randall Chin
(74) *Attorney, Agent, or Firm*—Darby & Darby

(57) ABSTRACT

Disclosed is a holding device including a handle and a support member pivotally connected to a front end of the handle for supporting a cleaning wiper. The support member has a pivot axis oriented in a direction crossing a shaft axis of the handle. The support member has sliding surfaces and recesses alternating with each other about the pivot axis. The handle has a locking member capable of engaging in the recesses. The locking member is movable along the shaft axis inside the handle. The locking member is provided along with a biasing member for applying a biasing force to the locking member toward the recesses and an operating member for moving the locking member against the biasing force.

5 Claims, 7 Drawing Sheets

HOLDING DEVICE AND CLEANING TOOL WITH THE HOLDING DEVICE

This application is a continuation of and claims priority under 35 U.S.C. § 371 to International Patent Application No. PCT/JP2003/009156, filed Jul. 18, 2003. The application further claims the benefit of Japanese Application 2002-212532, filed Jul. 22, 2002. The International Application was published in Japanese on Jan. 29, 2004 as International Publication No. WO/2004/008935. The contents of the above-referenced applications are incorporated herein by reference.

BACKGROUND OF THE INVENTION

1. Field of the Invention

The present invention relates to a device for holding a disposable or reusable cleaning wiper and a cleaning tool constructed of the holding device and the cleaning wiper.

2. Description of the Related Art

Japanese Unexamined Patent Publication Nos. 9-154791 and 9-38009 disclose cleaning tools for holding a cleaning cloth comprising nonwoven fabric and the like, in which a head for supporting the cleaning cloth is provided at a front end of a short handle or axially extendable handle that can be held with one hand.

However, since the head disclosed in the above-mentioned Patent Publications is fixed in position so as not to move at the front end of the handle, the handle held with hand for cleaning a surface to be cleaned with the cleaning cloth attached to the head need be turned in various directions in accordance with the shape of the surface to be cleaned. Therefore, it is not suitable for cleaning a variously oriented surface to be cleaned such as furniture surface.

On the other hand, Japanese Unexamined Patent Publication Nos. 51-85273 and 2002-17640 disclose cleaning tools in which a brush-like cleaning device is attached to a front end of a handle so as to be adjustable in position.

More specifically, the brush-like cleaning device used for these cleaning tools is pivotally attached to the front end of the handle. In this pivot connection, a plurality of recesses are formed in an outer periphery of a rotary portion that rotates together with the cleaning device, while a locking member for fitting in the recesses are provided in the handle, so that the position of the brush-like cleaning device can be changed and fixed by fitting the locking member in the recesses.

In the cleaning tool disclosed in Japanese Unexamined Patent Publication No. 51-85273, however, the fit of the locking member in the recess is stabilized after positioning of the cleaning device with a rotary ring, which is threadably attached to an external thread formed around the handle, tightened along the external thread. Therefore, every time the position of the cleaning device is to be changed, there will be required such an extremely laborious operation that the rotary ring is first turned in the loosening direction of the thread for changing the position of the cleaning device and then the rotary ring is turned in the tightening direction of the thread. In addition, the front end of the handle becomes not only thicker but also heavier due to the provision of the rotary ring.

In the cleaning tool disclosed in Japanese Unexamined Patent Publication No. 2002-17640, on the other hand, after the position of the brush-like cleaning device is pivotally changed, an operating part provided in the handle should be pushed forwardly of the handle by hand so as to fit a locking part provided in the operating part into the recess. Thus, the operating part need be strongly pushed forwardly of the handle by finger for setting the cleaning device in position, so that the operation for setting the cleaning device in position becomes laborious.

In the cleaning tools disclosed in the two Patent Publications, moreover, the locking member cannot enter the recess if the rotary ring is turned or the operating part is pushed forward by hand before the locking member is exactly confronted by the recess, so that the locking member sometimes fails in fitting into the recess. Accordingly, the operation of the rotary ring or the operating part must be done after the locking member is confronted by the recess, so that it tends to take much time to certainly fix the cleaning device in position.

In the cleaning tools disclosed in the two Patent Publications, still moreover, although the position of the brush-like cleaning device can be changed within a predetermined angular range, the cleaning device cannot be folded back to overlie the handle. That is, the cleaning tools disclosed in the two Patent Publications are not intended to support a disposable cleaning wiper, but the brush-like cleaning device for a long time use is attached to the handle. Therefore, the holding device is intended to be left attached even when it is not used, not assuming such a usage that the cleaning tool is folded back for storage with a wiper removed therefrom, unlike a cleaning tool to which a disposable wiper is intended to be attached.

SUMMARY OF THE INVENTION

The present invention has been worked out in view of the shortcomings in the prior art set forth above. It is therefore an object of the present invention to provide a holding device, wherein the position of a support member to which a cleaning wiper is to be attached can be changed with a simple operation and the support member can be stabilized in predetermined positions without causing unexpected turn, and a cleaning tool with the holding device.

According to a first aspect of the present invention, there is provided a holding device for a cleaning wiper comprising:

a handle; and a support member pivotally connected to a front end of the handle for supporting a cleaning wiper, the support member having a pivot axis oriented in a direction crossing a shaft axis of the handle, wherein the support member has sliding surfaces that are formed at a predetermined normal distance from the pivot axis and recesses that are formed toward the pivot axis from the sliding surfaces, the sliding surfaces and the recesses alternating with each other about the pivot axis, and the handle has a locking member capable of engaging in the recesses, the locking member being movable along the shaft axis inside the handle, the locking member being provided along with a biasing member for applying a biasing force to the locking member toward the recesses and an operating member for moving the locking member in a direction opposite to the biasing force of the biasing member.

In the holding device, the locking member can be released from the recesses by moving the locking member away from the recesses against the biasing force of the biasing member, thereby permitting the support member to turn. Thereafter, when the operating force to the locking member is eliminated, the locking member moves along the axis of the handle due to the biasing force, whereby the locking member fits in one recess so that the support member goes to an engaged and fixed state (locked state).

Here, even if the locking member is not confronted by the recess at the time when the operating force to the locking member is eliminated, the locking member subjected to the biasing force comes into contact with the sliding surface, and therefore, when the support member is turned a little in such a state, the locking member can automatically fit in the recess due to the biasing force so that the support member goes to the engaged and fixed state. That is, when the position of the support member is to be changed, the support member can automatically go to the engaged and fixed state such that the locking member is moved away from the recess by operation of the operating member, the operating member is let go of during a turn of the support member, and then the support member is turned only a little more. Thus, the operation for changing the position of the support member is quite simple.

In the holding device, moreover, since the locking member is so provided axially movably inside the handle as to fit in the recess of the support member, the locking member can be made thick as well as the support member can be made wide at its portion having the recesses. Accordingly, the locking strength when the locking member fits in the recess can be increased. In addition, the handle can be made thin when the locking member is provided axially movably.

Moreover, since the locking member provided in the handle along with the operating member is separate from the pivot connection, the pivot connection between the handle and the support member can be of a simple construction and the radius from the pivot axis to the sliding surfaces can be made large to increase the fixing strength when the locking member is engaged with and fixed to the recess. Accordingly, when the support member goes to the engaged and fixed state, the position of the support member can be stabilized so as not to cause unexpected change.

The present invention may be constructed such that the sliding surfaces are formed on an imaginary cylindrical surface with center at the pivot axis.

If the sliding surfaces are part of the cylindrical surface, when the support member is turned with the locking member in contact with the sliding surface, the locking member can smoothly slide on the sliding surface to fit into the recess. In the present invention, however, the sliding surfaces located between adjacent recesses may be flat surfaces extending in a direction tangential to an imaginary circle with center at the pivot axis.

The present invention may be constructed such that the support member has a cleaning support surface for pressing a cleaning wiper attached thereto against a surface to be cleaned, wherein selective engagement of the locking member in the recesses permits a stepwise change of angle between the shaft axis and the cleaning support surface.

With the stepwise change of the angle of the cleaning support surface for pressing the cleaning wiper against a surface to be cleaned, the handle can be held with hand always in suitable positions for cleaning operation, so that an object such as furniture having variously oriented surfaces to be cleaned, ceiling, and the like can be easily cleaned.

In the present invention, it is preferred that one of the recesses is a fold locking recess and when the locking member engages in the fold locking recess, the support member is folded back to substantially overlie the handle.

If the fold locking recess is provided, when the holding device is not used, the support member can be folded back to substantially overlie the handle with the cleaning wiper removed from the support member, for instance, so that a large storage space is not required.

The present invention may be constructed such that the operating member is a push button that is externally exposed on an outer periphery of the handle and movable in a direction crossing the shaft axis, and at least one of the push button and the locking member has an inclined sliding surface inclined to both a direction along which the push button is to be pushed and a direction along which the locking member is movable, wherein a sliding component force acting on the inclined sliding surface as the push button is pushed permits the locking member to move against the biasing force of the biasing member.

In the present invention, since the locking member is provided to be movable axially of the handle, the handle can be made thin, as set forth above. In this construction, if the push button is provided to be movable in a direction crossing the shaft axis of the handle, the operation for releasing the engagement and fixation (lock) between the locking member and the recess can be performed quite easily.

Alternatively, the present invention may be constructed such that the operating member is a sliding button that is externally exposed on an outer periphery of the handle and movable along the shaft axis, wherein the sliding button permits the locking member to move against the biasing force of the biasing member.

If the sliding button is thus provided to be movable axially of the handle, the inner structure of the handle can be made simple, and even if the handle is made thin, the locking member can be certainly operated.

According to a second aspect of the present invention, there is provided a cleaning tool comprising: the foregoing holding device; and a cleaning wiper to be attached to the support member, wherein the cleaning wiper is a disposable wiper comprising nonwoven fabric, paper or a combination of nonwoven fabric and a bundle of fibers, and the cleaning wiper is supported by the support member with the support member inserted into holding spaces formed in the cleaning wiper.

In this construction, since the cleaning wiper can be made soft, it can easily be attached to the support member or replaced.

BRIEF DESCRIPTION OF THE DRAWINGS

The present invention will be understood more fully from the detailed description given hereinafter and from the accompanying drawings of the preferred embodiments of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figures 1A, 1B, 1C:
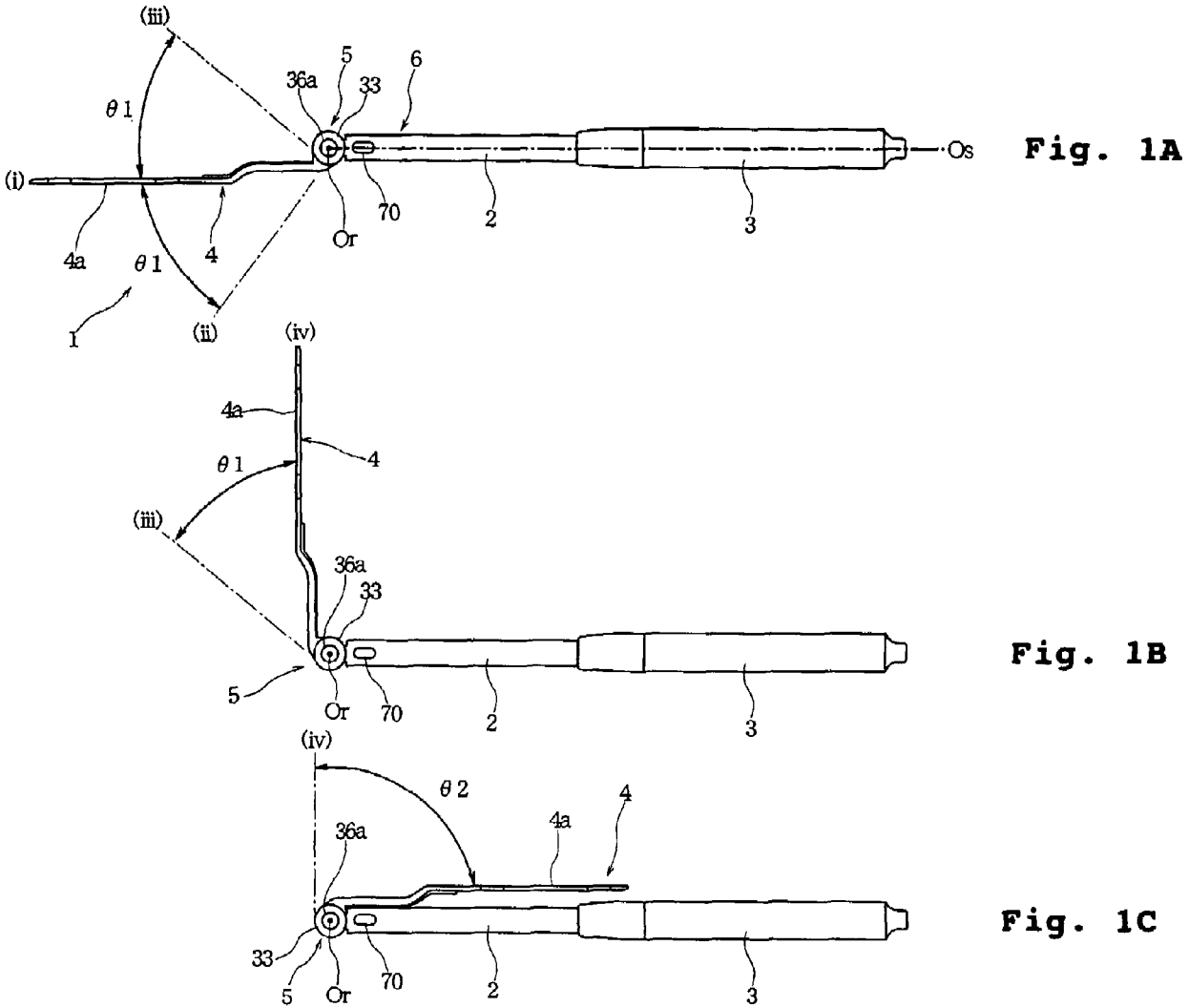
FIGS. 1A, 1B and 1C are general side views showing a holding device according to a first embodiment of the present invention, wherein a support member is in different positions.

FIGS. 1A, 1B and 1C are general side views showing a holding device according to a first embodiment of the present invention, wherein FIG. 1A shows a state where a cleaning support surface of a support member is oriented parallel with a shaft axis of a handle, FIG. 1B shows a state where the cleaning support surface is oriented perpendicular to the shaft axis of the handle, and FIG. 1C shows a state where the support member is folded back to substantially overlie the handle.

Figure 2:
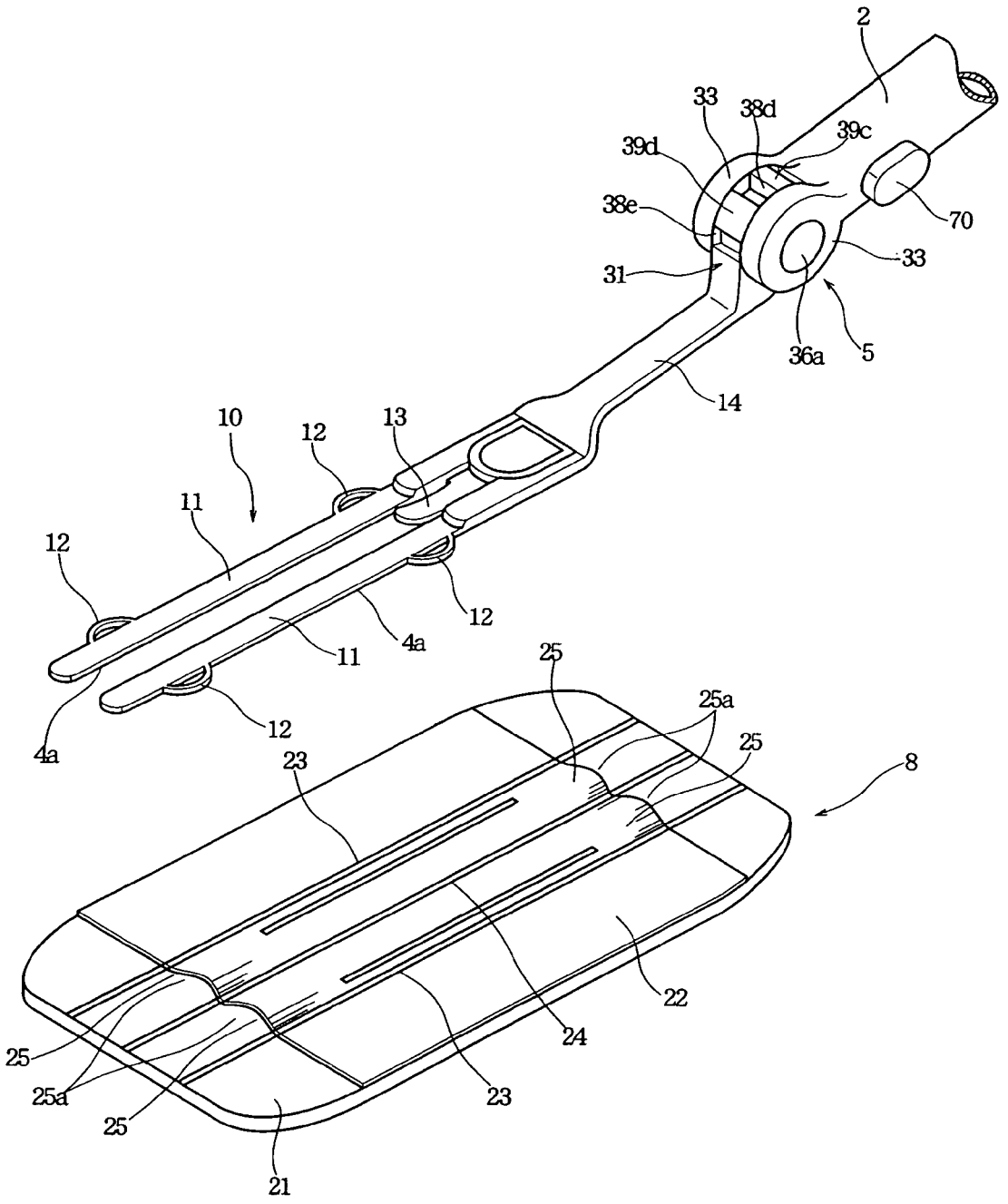
FIG. 2 is a perspective view showing the support member of the holding device and a cleaning wiper.
Figure 3:
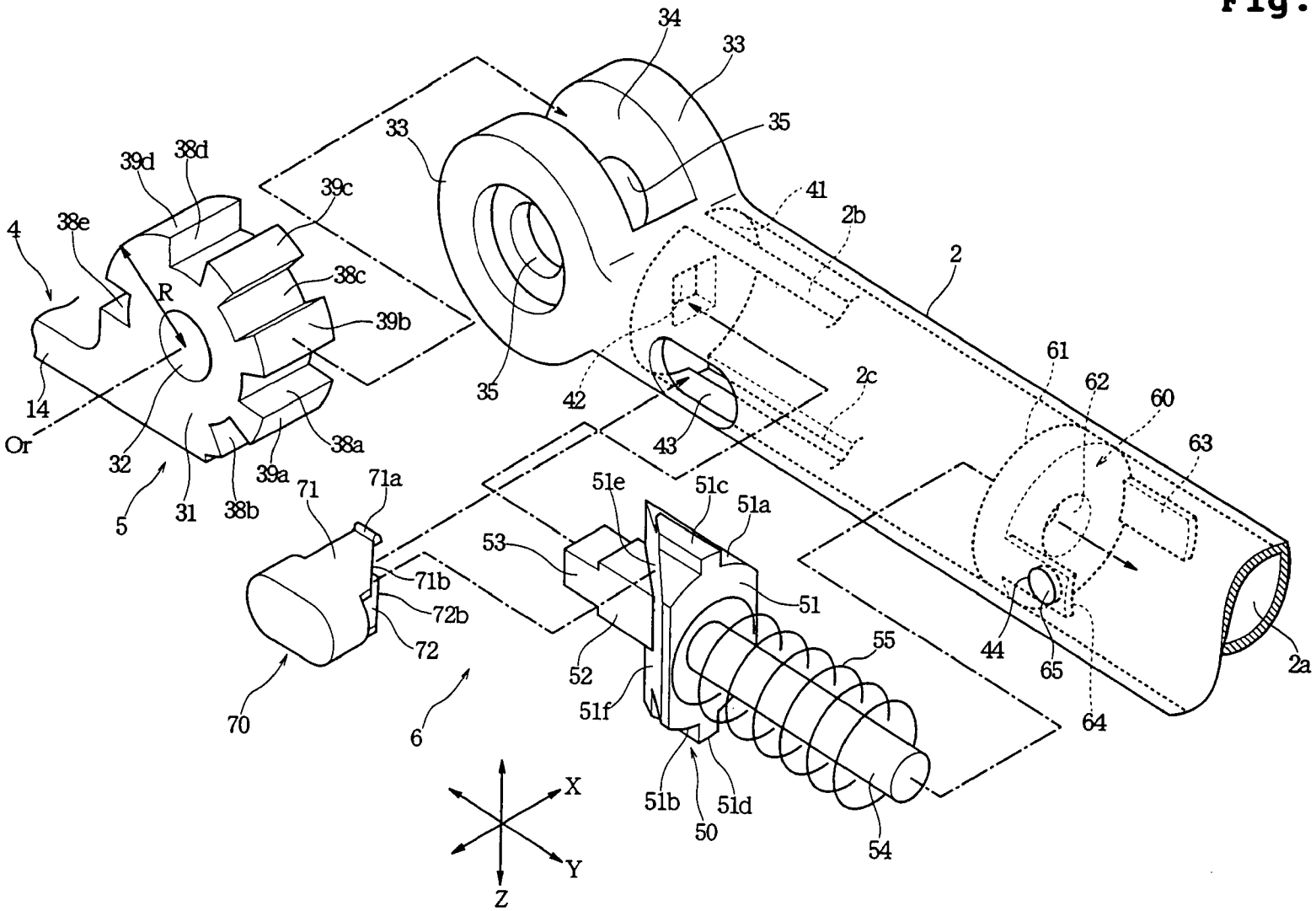
FIG. 3 is an exploded perspective view showing a pivot connection and a locking mechanism in the holding device.
Figure 4:
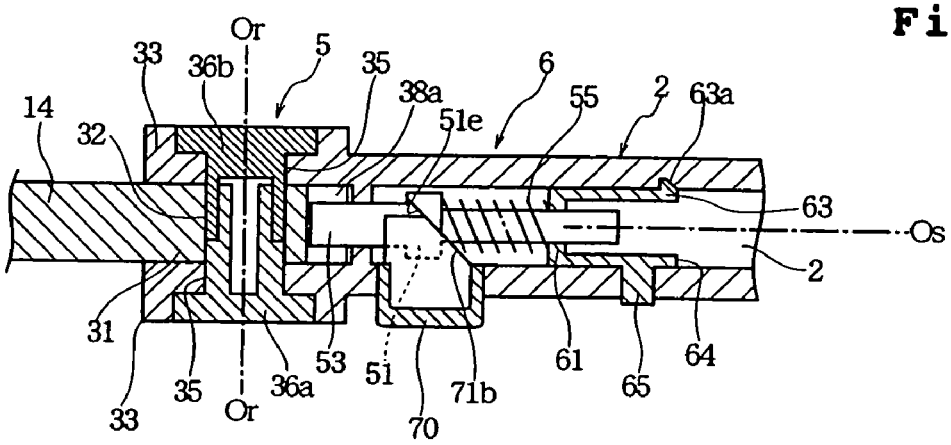
FIG. 4 is a sectional view of the holding device taken along an XY-plane of FIG. 3.

FIG. 2 is a perspective view showing a structure of the support member and a cleaning wiper to be attached to the support member; FIG. 3 is an exploded perspective view showing a pivot connection between the handle and the support member and a locking mechanism; FIG. 4 is a sectional view taken along an XY-plane, showing the pivot connection and the locking mechanism; and FIGS. 5A and 5B and FIGS. 6A and 6B are sectional views taken along a YZ-plane, showing the support member in different positions.

As shown in FIGS. 1A, 1B and 1C, a holding device 1 has a handle 2 and a housing handle 3. In FIGS. 1A, 1B and 1C, the handle 2 is illustrated as projecting forwardly from the housing handle 3, but the handle 2 can be retracted into the housing handle 3 so as to decrease the length of the assembly of the handle 2 and the housing handle 3. It should be noted that the housing handle 3 may be a telescopic handle so as to increase the length of the assembly of the handle 2 and the housing handle 3.

As shown in FIG. 3 and the following Figures, the handle 2 is a cylinder of a hollow circular cross-section. The housing handle 3 is also a cylinder of a hollow circular cross-section. Referring to FIG. 1A, the shaft axis of the handle 2 and the housing handle 3 is indicated by Os.

A support member 4 is pivotally connected to the front end of the handle 2 through a pivot connection 5. The pivot axis of the support member 4 at the pivot connection 5 is indicated by Or. In the present embodiment, the pivot axis Or is oriented in a direction perpendicularly intersecting the shaft axis Os of the handle 2. The support member 4 is pivotable about the pivot axis Or, and after the support member 4 is turned to respective positions, the support member 4 can be engaged and fixed (locked) by a locking mechanism 6 provided inside the handle 2.

Referring to FIG. 1A, the lower surface of the support member 4 is a cleaning support surface 4*a* for pressing a cleaning wiper 8 attached to the support member 4 against a surface to be cleaned. In the present embodiment, the support member 4 can be engaged and fixed at five different positions.

FIG. 1A shows a first cleaning position (i), in which the cleaning support surface 4*a* of the support member 4 is substantially parallel with the shaft axis Os of the handle 2, a second cleaning position (ii), in which the cleaning support surface 4*a* is turned by θ1 downwardly from the first cleaning position (i), and a third cleaning position (iii), in which the cleaning support surface 4*a* is turned by θ1 upwardly from the first cleaning position (i).

FIG. 1B shows a fourth cleaning position (iv), in which the cleaning support surface 4*a* is further turned by θ1 upwardly from the third cleaning position (iii), and at this time, the cleaning support surface 4*a* becomes substantially perpendicular to the shaft axis Os. When the support member 4 is further turned clockwise by θ2 from the fourth cleaning position (iv) of FIG. 1B, the support member 4 thus folded back overlies the handle 2 to take a folded position (v), wherein the cleaning support surface 4*a* faces upward and becomes substantially parallel with the shaft axis Os.

The pivot angles θ1 of the support member 4 between adjacent cleaning positions are equal, while the pivot angel θ2 of the support member 4 from the fourth cleaning position (iv) to the folded position (v) is set larger than the pivot angles θ1 between adjacent cleaning positions. For instance, θ1 is 45 degrees, and θ2 is 90 degrees.

At the front end of the handle 2, there is provided a push button 70 as operating member for releasing the engagement and fixation (lock) through the locking mechanism 6, wherein the push button 70 projects outwardly beyond the outer periphery of the handle 2. In order that the push button 70 can be operated even when the support member 4 is folded back against the handle 2 into the folded position (v), the push button 70 is so positioned as not to interfere with the operation of the support member 4 in the folded position (v).

Individual components constituting the handle 2, the housing handle 3, the support member 4, the pivot connection 5 and the locking mechanism 6 are all made of synthetic resin, such as ABS, vinyl chloride, PE (polyethylene), PP (polypropylene) and PET (polyethylene terephthalate), except for coil spring.

As shown in FIG. 2, the support body 4 has an arm 14 extending forwardly from the pivot connection 5, and the arm 14 is bifurcated to provide support strips 11, 11 in the form of parallel flat plates. Along an outer edge of the individual support strips 11, two thin deformable projections 12, 12 are integrally formed. At the bifurcation point between the support strips 11, 11, a clip 13 is integrally formed to extend forwardly between the support strips 11, 11. Here, the lower surfaces of the support strips 11, 11 are regarded as the cleaning support surface 4*a*.

The cleaning wiper 8 of FIG. 2 is a disposable, soft wiper, of which a main body 21 comprises a nonwoven fabric, a stack of nonwoven fabrics, a stack of papers, a foamed resin material, a stack of a nonwoven fabric and a bundle of fibers that is referred to as tow, or the like. On the main body 21, laid is a holding sheet 22 that comprises a nonwoven fabric or the like. The main body 21 and the holding sheet 22 are joined together at a pair of longitudinally extending side bond lines 23, 23 and a center bond line 24 extending parallel with and between the two side bond lines 23, 23.

Between the main body 21 and the holding sheet 22, there are formed holding spaces 25, 25 individually defined between one side bond line 23 and the center bond line 24. The individual holding spaces 25 have openings 25*a*, 25*a* on longitudinally opposite sides of the main body 21. When the support strips 11, 11 of the support member 4 are inserted into the holding spaces 25, 25 through the openings 25*a*, 25*a* from either side, the upper surface of the holding sheet 22 is pressed by the clip 13, whereby the cleaning wiper 8 attached to the support member 4 can be prevented from easily detaching therefrom.

With the cleaning wiper 8 thus attached to the support member 4, the main body 21 of the cleaning wiper 8 beneath the cleaning support surface 4*a* (i.e., the lower surfaces of the support strips 11, 11) can be pressed against a surface to be cleaned such as floor and furniture.

It should be noted that a washable (reusable) cleaning wiper may be attached to the support member 4, in place of the disposable wiper.

As shown in FIG. 3, the support member 4 is integrally formed, at its rear end of the arm 14, with a generally disc-shaped rotary portion 31, and a shaft hole 32 is formed to passes through the rotary portion 31 in the X-direction. The handle 2 is integrally formed, at its front end, with a pair of disc-shaped support portions 33, 33 to have a support space 34 between the support portions 33, 33. Support holes 35, 35 are formed to pass through the support portions 33, 33 in the X-direction.

The thickness of the rotary portion 31 formed in the support member 4 is substantially equal to the width of the support space 34, so that the rotary portion 31 can be inserted into the support space 34 substantially without play. As shown in FIG. 4, a first support shaft 36*a* is inserted into the support hole 35 from outside one support portion 33, while a second support shaft 36*b* is inserted into the support hole 35 from outside the other support portion 33. The first and second support shafts 36*a*, 36*b* are then inserted into the shaft hole 32 of the rotary portion 31 to fit each other within the shaft hole 32, wherein the first and second support shafts 36*a*, 36*b* may be bonded and fixed to each other, if desired.

As a result, the rotary portion 31, being integral with the support member 4, becomes rotatable about the first and second support shafts 36*a*, 36*b*. The shaft axis of the first and second support shafts 36*a*, 36*b* is the pivot axis Or. In the present embodiment, as has been described hereinabove, the pivot axis Or is oriented in a direction perpendicularly intersecting the shaft axis Os of the handle 2.

Figure 5A:
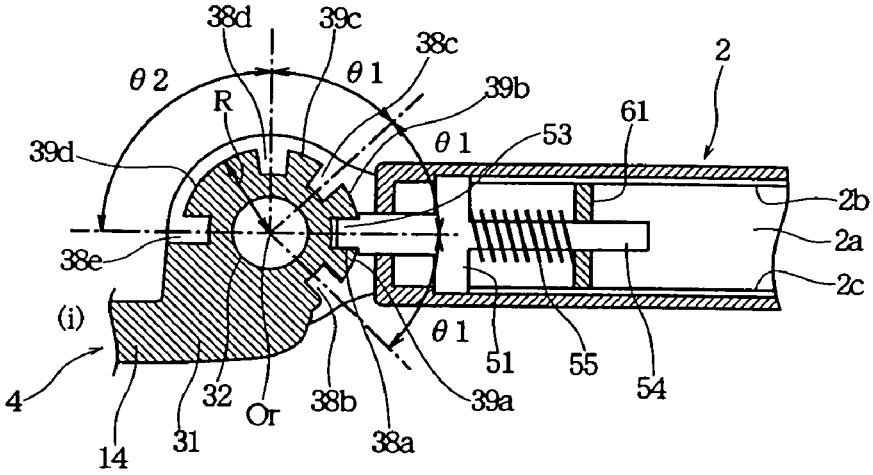
FIGS. 5A and 5B are sectional views of the holding device taken along a YZ-plane of FIG. 3, wherein the support member is in different positions.

As shown in FIG. 3 and FIG. 5A, the rotary portion 31, being integral with the support member 4, has first, second third and fourth recesses 38*a*, 38*b*, 38*c* and 38*d* formed in circumferentially spaced relation toward the pivot axis Or. As shown in FIG. 3, the individual recesses 38*a*, 38*b*, 38*c* and 38*d* are formed linearly along the X-direction (direction parallel with the pivot axis Or) at a constant width. Here, adjacent recesses (i.e., the first and second recesses 38*a* and 38*b*, the first and third recesses 38*a* and 38*c*, and the third and fourth recesses 38*c* and 38*d*) are spaced apart from each other by θ1 circumferentially about the pivot axis Or, as shown in FIG. 5A. The θ1 is 45 degrees, for instance.

Moreover, a fold locking recess 38*e* is provided at a position spaced counterclockwise apart from the fourth recess 38*d* by θ2. The 02 is 90 degrees, for instance.

Thus, a first sliding surface 39*a* is provided between the first and second recesses 38*a* and 38*b*, a second sliding surface 39*b* is provided between the first and third recesses 38*a* and 38*c*, and a third sliding surface 39*c* is provided between the third and fourth recesses 38*c* and 38*d*. Between the fourth recesses 38*d* and the fold locking recess 38*e*, furthermore, provided is a fold sliding surface 39*d*. The individual sliding surfaces 39*a*, 39*b*, 39*c* and 39*d* are formed on an imaginary cylindrical surface with radius R and center at the pivot axis Or.

In the present embodiment, since the rotary portion 31 of the support member 4 is held between the support portions 33 and 33 provided at the front end of the handle 2, not only the width but also the radius R of the rotary portion 31 can be made relatively large, so that the strength of engagement and fixation (locking strength) at the time when a locking projection 53 (which will be described later in detail) fits in the recess can be increased.

Next, the structure of the locking mechanism 6 will be described.

As shown in FIG. 3, the handle 2 is a cylinder having a mechanism housing space 2*a* inside of it. In the handle 2, a partition 41 is integrally formed to separate the mechanism housing space 2*a*, at its front side adjacent the support portions 33, from the support space 34, and a rectangular window 42 is formed to pass through the partition 41 axially of the handle 2 (i.e., along the shaft axis Os).

At a location closely spaced apart from the support portions 33 toward the rear side (toward the housing handle 3), the handle 2 has an operating hole 43 passing through the cylinder wall of the handle 2 in the X-direction. At a location spaced apart from the operating hole 43 toward the rear side, there is also formed a small-diameter fitting hole 44 passing through the cylinder wall in the X-direction. In the inner periphery of the handle 2, a pair of sliding grooves 2*b* and 2*c* are formed to extend axially of the handle 2 from the inward surface of the partition 41. The sliding grooves 2*b* and 2*c* are located in opposite positions vertically (in the Z-direction).

Into the mechanism housing space 2*a* of the handle 2, a locking member 50 is inserted. The locking member 50 has a sliding body 51, whose upper and lower surfaces 51*a* and 51*b* are curved surfaces having the same curvature as the inner periphery of the handle 2 that defines the mechanism housing space 2*a*, so that when the locking member 50 is inserted into the mechanism housing space 2*a*, the upper and lower surfaces 51*a* and 51*b* can slide on the inner periphery defining the mechanism housing space 2*a*.

The sliding body 51 also has a rib 51*c* extending along the Y-direction on the upper surface 51*a* and a rib 51*d* extending along the Y-direction on the lower surface 51*b*. Since the ribs 51*c* and 51*d* can slidingly fit in the sliding grooves 2*b* and 2*c*, the locking member 50 is permitted to move axially of the handle 2 without rotating inside the mechanism housing space 2*a*.

In the locking member 50, a sliding shaft 52 of a rectangular cross-section is provided axially of the handle 2 to extend forwardly from the sliding body 51. The sliding shaft 52 is inserted into the window 42 formed in the partition 41. At the front end of the sliding shaft 52, the locking projection 53 of a rectangular cross-section is integrally formed and is permitted to project into the support space 34.

At its front side, the sliding body 51 has inclined sliding surfaces 51*e* and 51*f* that are located in opposite positions across the sliding shaft 52 vertically (in the Z-direction). The inclined sliding surfaces 51*e* and 51*f* are inclined to both the Y-direction along which is the axis of the handle 2 extends and the X-direction along which the push button 70 is to be pushed.

In the locking member 50, a guide shaft 54 of a circular cross-section is integrally formed to extend rearwardly from the sliding body 51 in the axial direction of the handle 2. Around the guide shaft 54, a compression coil spring 55 is provided as biasing member.

In the mechanism housing space 2*a*, a stopper 60 is located at a position spaced apart from the partition 41 toward the rear side. The stopper 60, as prepared separately from the handle 2, has a disc-shaped stopper wall 61 that is opposite the partition 41, and a circular guide hole 62 is formed centrally of the stopper wall 61 to pass through it axially of the handle 2. The stopper 60 has a pair of resilient arms 63 and 64 extending rearwardly from the stopper wall 61. As shown in FIG. 4, one resilient arm 63 is integrally formed with a fitting claw 63*a* for fitting in a groove formed in the inner periphery of the handle 2, while the other resilient arm 64 is integrally formed with a fitting projection 65 for fitting in the fitting hole 44 to appear on the outer periphery of the handle 2.

After the locking member 50 and the compression coil spring 55 are inserted into the mechanism housing space 2*a* and the sliding shaft 52 is inserted into the window 42, the stopper 60 is assembled in the mechanism housing space 2*a* such that the fitting claw 63*a* of the resilient arm 63 fits in the groove formed in the inner periphery of the handle 2 while the fitting projection 65 fits in the fitting hole 44, thereby securing the stopper 60 so as not to slip off.

Then, the guide shaft 54 of the locking member 50 is inserted into the guide hole 62 of the stopper wall 61, so that the compression coil spring 55 is disposed between the partition 41 and the stopper wall 61 in a compressed state. Due to a biasing force of the compression coil spring 55, the locking member 50 is always biased toward the support space 34.

It should be noted that the locking member 50 can be removed out of the mechanism housing space 2*a* by pushing the fitting projection 65 with a finger to release the fitting projection 65 inwardly from the fitting hole 44.

In the operating hole 43 formed in the handle 2, the push button 70 as operating member is disposed. The push button 70 is integrally formed with a pair of operating arms 71 and 72 that are opposite one another vertically (in the Z-direction): the operating arm 71 having an engaging claw 71*a* that projects outwardly; the operating arm 72 having an engaging claw (not shown) that likewise projects outwardly. The push button 70 is inserted into the mechanism housing space 2*a* of the handle 2 to project outwardly through the operating hole 43. The push button 70 thus assembled is permitted to project outwardly a predetermined distance, but prevented from slipping out of the operating hole 43 by contact of the engaging claw 71*a* of the operating arm 71 and the engaging claw (not shown) of the operating arm 72 with a stopper (not shown) provided in the mechanism housing space 2*a*. The push button 70 is provided movably in the X-direction.

The operating arms 71 and 72 of the push button 70 have contact portions 71*b* and 72*b* for facing the sliding body 51 of the locking member 50. The contact portions 71*b* and 72*b* are inclined in the same direction as the inclined sliding surfaces 51*e* and 51*f* of the sliding body 51, so that the contact portions 71*b* and 72*b* are in sliding contact with the inclined sliding surfaces 51*e* and 51*f*.

Next, how to operate the holding device 1 will be described.

In the first cleaning position (i) where the cleaning support surface 4*a* of the support member 4 is substantially parallel with the shaft axis Os of the handle 2, as shown in FIG. 1A, the pivot connection 5 and the locking mechanism 6 are in the state of FIG. 5A.

In FIG. 5A, since the locking member 50 is biased toward the support space 34 due to the biasing force of the compression coil spring 55, the locking projection 53 integrally formed in the locking member 50 fits in the first recess 38*a* of the rotary portion 31 provided at the rear end of the support member 4. Accordingly, the support member 4 is engaged and fixed (locked) in the first cleaning position (i) of FIG. 1A.

Here, since the contact portions 71*b* and 72*b* of the push button 70 are pressed toward the partition 41 with the inclined sliding surfaces 51*e* and 51*f* of the locking member 50, the push button 70 is projecting beyond the outer periphery of the handle 2 due to a sliding component force of the inclined sliding surfaces 51*e* and 51*f*, as shown in FIG. 4. The push button 70 thus projecting can be operated from outside the outer periphery by pushing.

In order to change the position of the support member 4, the push button 70 is first pushed along the X-direction of FIG. 3. When the push button 70 is pushed, the inclined sliding surfaces 51*e* and 51*f* are pushed by the contact portions 71*b* and 72*b* and their component force makes the locking member 50 move away from the support space 34 against the spring force of the compression coil spring 55. As a result, the locking projection 53 of the locking member 50 comes out of the first recess 38*a* to release the engagement and fixation of the support member 4.

After the engagement and fixation of the support member 4 is released, the support member 4 is turned while the push button 70 is being kept pushed, and then, the pressing force against the push button 70 is eliminated at the time when the locking projection 53 is confronted by any one of the recesses 38*b*, 38*c*, 38*d* and 38*e*. Here, the locking member 50 moves forward due to the biasing force of the compression coil spring 55 so that the locking projection 53 fits in the confronting one of the recesses for engagement and fixation of the support member 4 in a selected position. When the locking projection 53 fits in the recess 38*b*, the support member 4 is in the second cleaning position (ii); when the locking projection 53 fits in the recess 38*c*, the support member 4 is in the third cleaning position (iii); when the locking projection 53 fits in the recess 38*d*, the support member 4 is in the fourth cleaning position (iv); and when the locking projection 53 fits in the fold locking recess 38*e*, the support member 4 is in the folded position (v).

Here, it should be noted that even if the pressing force against the push button 70 is eliminated before the locking projection 53 is confronted by one of the recesses during the position change of the support member 4, the locking projection 53 can certainly fit in one of the recesses that is the closest to the locking projection 53 in the turning direction of the support member 4. That is, it is not necessary to keep applying the pressing force against the push button 70 until the locking projection 53 is aligned with the recess.

Figure 5B:
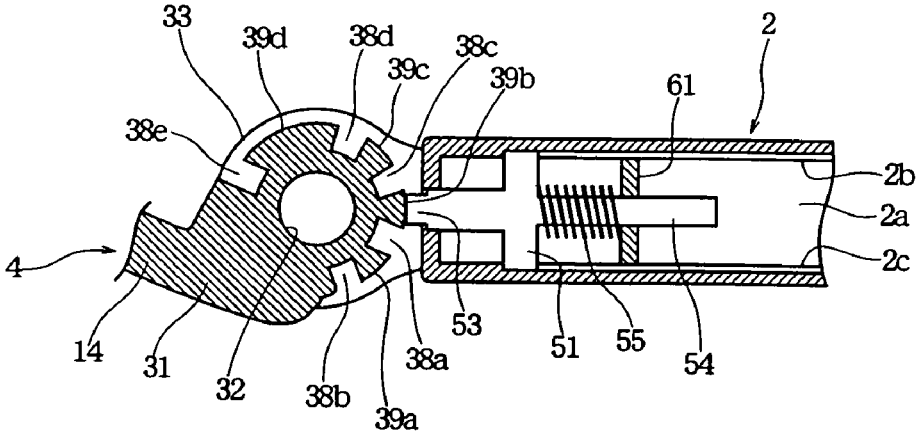

For instance, after the locking projection 53 is released from the first recess 38*a* by pushing the push button 70 to make the locking member 50 move rightward from the engaged and fixed position of FIG. 5A in which the locking projection 53 is fitting in the first recess 38*a*, the support member 4 is turned a little clockwise and the pressing force against the push button 70 is eliminated. Then, the locking member 50 moves forward due to the biasing force of the compression coil spring 55 to press the tip end of the locking projection 53 against the second sliding surface 39*b* adjacent to the first recess 38*a*, as shown in FIG. 5B. If the support member 4 in this position is turned a little more clockwise without pushing the push button 70, the tip end of the locking projection 53 subjected to the biasing force of the compression coil spring 55 slides along the second sliding surface 39*b* and then moves into the third recess 38*c* automatically, thereby engaging and fixing the support member 4 in the third cleaning position (iii).

Figure 6A:
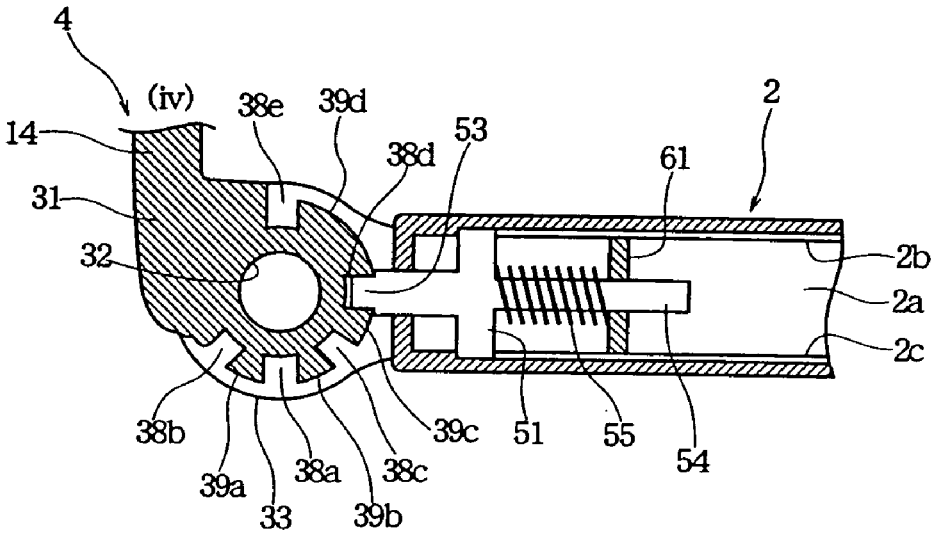
FIGS. 6A and 6B are sectional views of the holding device taken along the YZ-plane of FIG. 3, wherein the support member is in different positions.
Figure 6B:
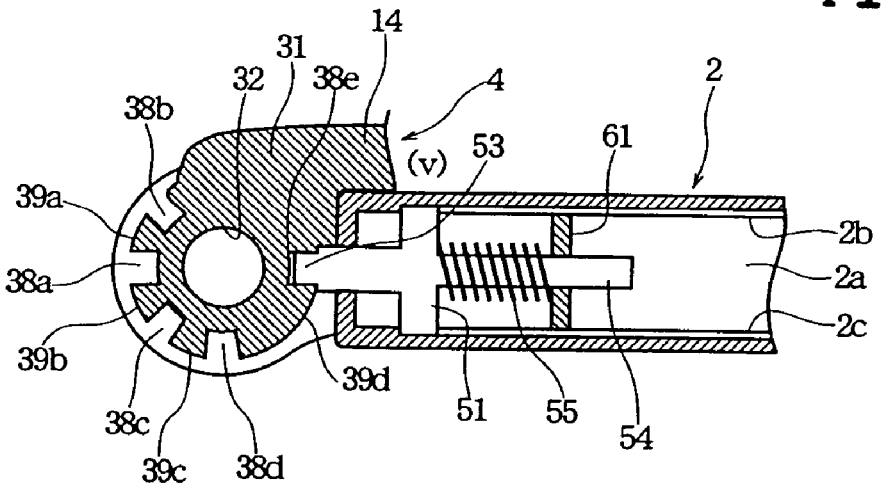

The locking projection 53 can likewise fit in the second and fourth recesses 38*b* and 38*d* and the fold locking recess 38*e*. FIG. 6A shows a state where the locking projection 53 fits in the fourth recess 38*d* for engaging and fixing the support member 4 in the fourth cleaning position (iv). Here, if the locking projection 53 is released from the fourth recess 38*d* by pushing the push button 70 and then the pressing force against the push button 70 is immediately eliminated, the tip end of the locking projection 53 is pressed against the fold sliding surface 39*d*. Accordingly, as the support member 4 is turned to the position of FIG. 6B, the tip end of the locking projection 53 slides along the fold sliding surface 39*d* and then fits in the fold locking recess 38*e*, thereby engaging and fixing the support member 4 in the folded position (v).

Thus, the support member 4 can be engaged and fixed in the respective positions with a simple operation that involves push and quick release of the push button 70. Folding back the support member 4 against the handle 2 into the folded position (v) and maintaining the support member 4 in the folded position (v) can also be performed only by pushing the push button 70 once and subsequently turning the support member 4.

It should be noted that the operation of the push button 70 is quite simple because the push button 70 can be operated only by pushing in a direction perpendicularly intersecting the shaft axis Os of the handle 2. In addition, since the push button 70 is so positioned as not to overlap with the support member 4 in the folded position (v) of FIG. 1C, the push button 70 can be easily pushed even in the folded position (v).

According to the present embodiment, the cleaning tool in which the cleaning wiper 8 is attached to the support member 4 can be used for cleaning upper surfaces of furniture and the like with the cleaning support surface 4*a* of the support member 4 engaged and fixed in the first cleaning position (i) of FIG. 1A or the second cleaning position (ii) and for cleaning floor surfaces and the like with the cleaning support surface 4*a* engaged and fixed in the third cleaning position (iii) or the fourth cleaning position (iv) of FIG. 1B. Moreover, the support member 4 can be turned from the fourth cleaning position (iv) into the folded position (v) of FIG. 1C. In the folded position (v), the holding device 1 can be compactly stored with the cleaning wiper 8 removed from the support member 4. The holding device 1 in the folded position (v) can be made more compact with the handle 2 retracted into the housing handle 3 to decrease the entire handle length for storage in a narrow space.

Figure 7:
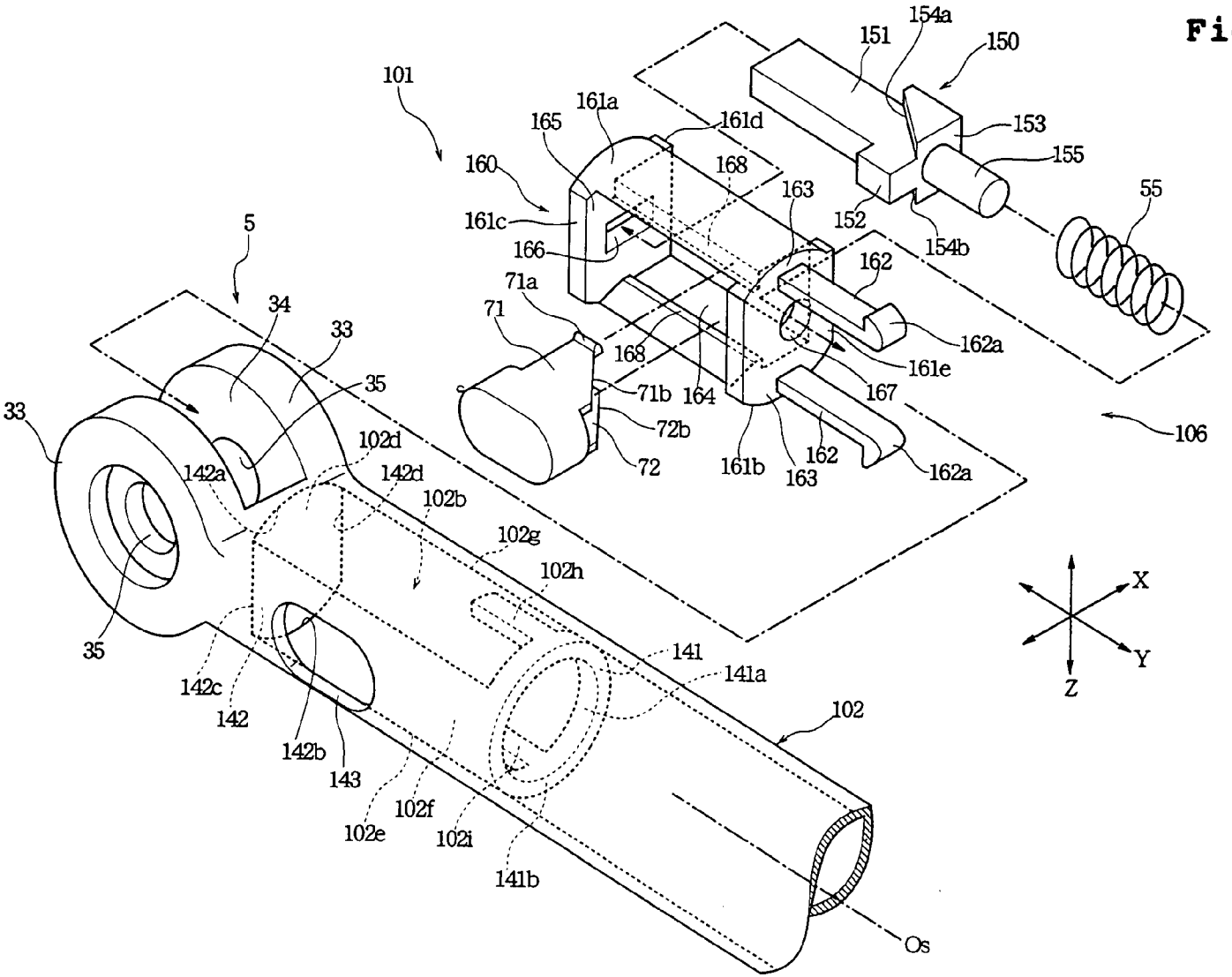
FIG. 7 is an exploded perspective view showing a locking mechanism in a holding device according to a second embodiment of the present invention.

FIG. 7 is an exploded perspective view showing a portion of a holding device 101 according to a second embodiment of the present invention.

The holding device 101 has a locking mechanism 106 whose construction is different from that of the locking mechanism 6 of the first embodiment, but a locking member 150 provided in the locking mechanism 106 with a different support structure operates in the same manner as the locking member 50 of the locking mechanism 6. Here, the support member 4 and the pivot connection 5 have the same construction as those of the holding device 1 according to the first embodiment. In addition, the pivotal operation of the support member 4 and the operation for engaging and fixing the support member 4 in the individual positions can be performed in the same manner as described with reference to FIGS. 1A, 1B, 1C, 4, 5A, 5B, 6A and 6B. Hereinbelow, only the portions of the holding device 101 having constructions different from those of the holding device 1 will be described.

FIG. 7 shows a handle 102 that is of a cylindrical shape and formed, at its front end, with the support portions 33, 33 for constituting the pivot connection 5 and the support space 34 between the support portions 33, 33.

Inside the handle 102, a ring-shaped stopper 141 is integrally formed to project inwardly from the inner periphery, and an engaging hole 141*a* is formed centrally of the stopper 141 to pass through it axially of the handle 102. Forwardly from the stopper 141, a mechanism housing space 102*b* is provided inside the handle 102. In the mechanism housing space 102*b*, upper and lower wall surfaces 102*d* and 102*e* opposite one another in the Z-direction are part of the inner periphery of the cylinder, while side wall surfaces 102*f* and 102*g* extending in the Z-direction are flat surfaces in parallel with the YZ-plane.

In the mechanism housing space 102*b*, a predetermined width of engaging rib 102*h* is formed on the upper wall surface 102*d* to extend forwardly from the stopper 141, while an engaging rib 102*i* is also formed on the lower wall surface 102*e* to extend forwardly from the stopper 141. At the front end of the mechanism housing space 102*b*, an opening 142 is formed to communicate with the support space 34. The opening shape of the opening 142 is such that upper and lower edges 142*a* and 142*d* are so arcuate as to continue to the upper and lower wall surfaces 102*d* and 102*e*, respectively, and two side edges 142*c* and 142*d* are so linear as to continue to the two side wall surfaces 102*f* and 102*g*, respectively.

At a location between the stopper 141 and the opening 142, the handle 102 has an operating hole 143 passing through the cylinder wall of the handle 102 in the X-direction.

In the mechanism housing space 102*b* of the handle 102, a guide member 160 is housed. In the guide member 160, upper and lower surfaces 161*a* and 161*b* are curved surfaces that match the upper and lower wall surfaces 102*d* and 102*e* defining the mechanism housing space 102*b*, while side surfaces 161*c* and 161*d* are flat surfaces that match the two side wall surfaces 102*f* and 102*g* defining the mechanism housing space 102*b*.

The guide member 160 is integrally formed with engaging arms 162, 162 extending rearwardly from vertically opposite positions of a rear end surface 161*e*, and the individual engaging arms 162, 162 are integrally formed, at their tip ends, with outwardly directed engaging claws 162*a*, 162*a*. At the base ends of the engaging arms 162, 162, shoulders 163, 163 are formed between the rear end surface 161*e* and the upper surface 161*a* and between the rear end surface 161*e* and the lower surface 161*b*.

Here, a sliding space 164 is formed to pass through the guide member 160 in the X-direction perpendicularly intersecting the axial direction (the Y-direction) of the handle 102. At the front end of the sliding space 164, a wall 165 for closing the opening 142 of the handle 102 is provided, and a rectangular sliding hole 166 is formed in the wall 165. In the rear end surface 161*e*, on the other hand, a circular guide hole 167 is formed to communicate with the sliding space 164. On upper and lower wall surfaces opposite one another in the Z-direction to define the sliding space 164 therebetween, engaging projections 168, 168 for preventing the push button 70 from slipping out are formed to project toward the sliding space 164.

The locking member 150 is housed in the sliding space 164. The locking member 150 functions in the same manner as the locking member 50 of the first embodiment, and is integrally formed, at its front end facing the support space 34, with a locking projection 151 of a rectangular cross-section. Stoppers 152 and 153 are formed at the rear end of the locking projection 151 to project in the X-direction, wherein inclined sliding surfaces 154*a* and 154*b* are formed in the stopper 153 in vertically opposite positions across the locking projection 151. The inclined sliding surfaces 154*a* and 154*b* are formed in the same angle as the inclined sliding surfaces 51*e* and 51*f* formed in the locking member 50 of the first embodiment.

In the locking member 150, a guide shaft 155 is integrally formed to extend rearwardly. Around the guide shaft 155, the compression coil spring 55 is provided as biasing member.

In the locking mechanism 106, the push button 70 identical to that used in the first embodiment is used as operating member.

Next, the assembly of the locking mechanism 106 will be described.

At first, the compression coil spring 55 is disposed around the guide shaft 155 of the locking member 150 and then the locking projection 151 and the guide shaft 155 are inserted into the sliding hole 166 and the guide hole 167. This assembly is performed such that one of the locking projection 151 and the guide shaft 155 is inserted into the hole 166 or 167 and then shifted in the Y-direction to let the other into the hole. When the locking member 150 is assembled in the guide member 160, the compression coil spring 55 is located between the stoppers 152 and 153 and the inner wall surface of the rear end surface 161*e*.

Then, the guide member 160 in which the locking member 150 and the compression coil spring 55 are assembled is inserted into the mechanism housing space 102*b* through the opening 142 of the handle 102. When thus inserted, the shoulders 163 and 163 at the rear end of the guide member 160 abut against the front end surfaces of the engaging ribs 102*h* and 102*i*, while the engaging arms 162 and 162 enter the engaging hole 141*a* so that engaging claws 162*a* and 162*a* of the engaging arms 162 and 162 engage a rear-side engaging surface 141*b* of the stopper 141. Thus, the guide member 160 can be housed in the mechanism housing space 102*b* while being prevented from moving axially of the handle 102 and rotating about the shaft axis Os. It should be noted that the opening 142 of the handle 102 is closed by the wall 165 of the guide member 160.

Thereafter, the pivot connection 5 is assembled. At this time, the locking projection 151 of the locking member 150 fits in any one of the recesses 38*a*, 38*b*, 38*c*, 38*d* and 38*e* of the rotary portion 31 of the support member 4 or abuts against any one of the sliding surfaces 39*a*, 39*b*, 39*c* and 39*d*.

Finally, the push button 70 is inserted into the operating hole 143 from outside the handle 102. At this time, the operating arms 71 and 72 of the push button 70 are elastically deformed to decrease the opposition interval therebetween so that the engaging claw 71*a* of the operating arm 71 and the engaging claw (not shown) of the operating arm 72 slide along the upper and lower wall surfaces of the guide member 160 that define the sliding space 164 therebetween. As the push button 70 is further pushed in, the engaging claw 71*a* of the operating arm 71 and the engaging claw (not shown) of the operating arm 72 engage the engaging projections 168 and 168 projecting toward the sliding space 164, so that the push button 70 is retained so as not to slip out of the guide member 160. As a result, the contact portions 71*b* and 72*b* of the operating arms 71 and 72 are brought into sliding contact with the inclined sliding surfaces 154*a* and 154*b* of the locking member 150.

The locking mechanism 106 thus assembled can operate in the same manner as the locking mechanism 6 of the first embodiment as shown in FIG. 4. That is, the locking projection 151 subjected to the biasing force of the compression coil spring 55 can fit in any one of the recesses 38*a*, 38*b*, 38*c*, 38*d* and 38*e* of the rotary portion 31. When the push button 70 is pushed, then, the locking member 150 moves away from the support space 34 due to slide between the contact portions 71*b* and 72*b* and the inclined sliding surfaces 154*a* and 154*b*, thereby releasing the fit of the locking projection 151 in the recess.

When the locking member 150 and the compression coil spring 55 are assembled in the guide member 160 and then the assembly is housed in the mechanism housing space 102*b* of the handle 102, as set forth above, the assembly is quite simple, so that the assembly can be performed efficiently.

Figure 8:
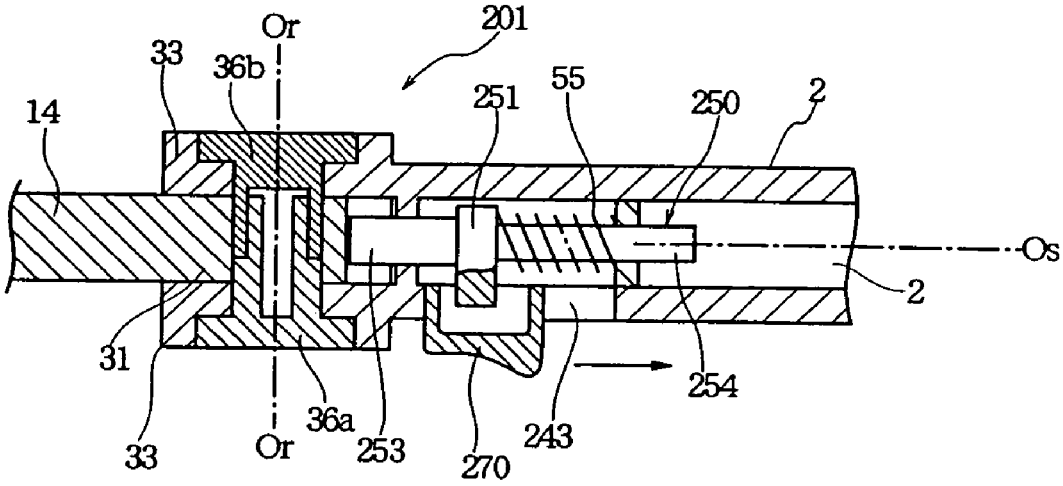
FIG. 8 shows a holding device according to a third embodiment of the present invention, which is a sectional view corresponding to FIG. 4.

FIG. 8 shows a holding device 201 according to a third embodiment of the present invention, which is a sectional view taken along the same plane as FIG. 4.

In the holding device 201, only the locking member and the operating member have different constructions from those of the holding device 1 of the first embodiment, but the other portions have the same constructions as those of the holding device 1. Therefore, the detailed description of the portions having the same constructions as those of the holding device 1 of the first embodiment will be omitted by designating them by the common reference numerals.

In the holding device 201 of FIG. 8, a locking member 250 is provided in the mechanism housing space 2*a* of the handle 2. The locking member 250 has a sliding body 251 axially slidingly supported in the mechanism housing space 2*a* and a locking projection 253 on the front side for facing the recesses 38*a*, 38*b*, 38*c*, 38*d* and 38*e* and the sliding surfaces 39*a*, 39*b*, 39*c* and 39*d* provided in the rotary portion 31 of the support member 4. The locking member 250 also has a guide shaft 254 on the rear side, around which the compression coil spring 55 is provided, so that the locking member 250 is always biased forwardly of the handle 2 due to the spring force of the compression coil spring 55.

The locking member 250 is provided along with a sliding button 270 as operating member. The sliding button 270 may be integral with or separate from the locking member 250. In the cylinder wall of the handle 2, there is formed an operating hole 243 being axially elongated slot. The sliding button 270 projects out of the handle 2 through the operating hole 243 so that the sliding operation of the sliding button 270 can be performed from outside the handle 2.

In the holding device 201, when the sliding button 270 is slid in the direction of the arrow of FIG. 8 from the engaged and fixed state where the locking projection 253 fits in the first recess 38*a* as in FIG. 5A, for instance, the locking member 250 moves in the direction of the arrow against the biasing force of the compression coil spring 55, so that the locking projection 253 is released from the first recess 38*a*. If the support member 4 is turned a little in such a state and then the operating force to the sliding button 270 is eliminated, the tip end of the locking projection 253 abuts against the second sliding surface 39*b*, as shown in FIG. 5B. By turning the support member 4 a little more in such a state, the locking projection 253 can fit in the third recess 38*c*, for instance.

In the embodiment shown in FIG. 8, if the sliding button 270 is separate from the locking member 250, as the sliding button 270 is slid in the direction of the arrow, the locking member 250 is moved in the direction of the arrow with pressed by the sliding button 270. In this case, the locking member 250 and the sliding button 270 are directly or indirectly engaged together through appropriate means.

In the foregoing embodiments, the engagement and fixation of the locking projection to one of the recesses 38*a*, 38*b*, 38*c*, 38*d* and 38*e* can be released by operating the push button or the sliding button, and subsequently, the locking projection sliding on one of the sliding surfaces 39*a*, 39*b*, 39*c* and 39*d* can automatically fit in the adjacent recess. Thus, the position of the support member 4 can be easily changed, and the support member 4 can be always stabilized in one of the positions (i), (ii), (iii), (iv) and (v) by letting the locking projection fit in one of the recesses 38*a*, 38*b*, 38*c*, 38*d* and 38*e*.

In the foregoing embodiments, since the locking mechanism is housed in the mechanism housing space of the handle so that only the push button or the sliding button projects beyond the outer periphery of the handle, the locking mechanism does not appear on the outer periphery of the handle to provide a compact appearance. In addition, since the locking member is provided axially movably in the handle, the locking mechanism can be housed in a thin handle. If the operating member is the push button 70 to be operated by pushing in a direction perpendicularly intersecting the shaft axis Os as shown in FIGS. 3 and 7, it can be operated easily. If the operating member is the sliding button 270 to be operated by sliding in the same direction as the locking member as shown in FIG. 8, on the other hand, the locking mechanism can be made more simple to make the handle much thinner.

Since the locking member is provided axially movably in the handle, moreover, the locking projection of the locking member can be made thicker within the inner diameter of the handle. In addition, since the recesses 38*a*-38*e* of the rotary portion 31 can be of an increased width in the X-direction, the strength of engagement and fixation when the locking projection fits in one of the recesses 38*a*, 38*b*, 38*c*, 38*d* and 38*e* can be increased.

Although the preferred embodiments of the present invention have been described in detail with reference to the accompanying drawings, the present invention should not be construed as limited to the specific embodiments, but various changes may be made without departing from the scope of the present invention.

For instance, although the shaft axis Os of the handle and the pivot axis Or of the support member have been described as perpendicularly intersecting each other in the foregoing embodiments, the axes Os and Or need not intersect each other exactly perpendicularly, as well as a plane inclusive of the axis Os and a plane inclusive of the axis Or need not be common.

The width of the recesses 38*a*, 38*b*, 38*c*, 38*d* and 38*e* formed in the rotary portion 31 may be constant in a direction normal to the pivot axis Or or may be radially increased in the normal direction. The locking projection of the locking member may be of any shape as long as can enter the recesses 38*a*, 38*b*, 38*c*, 38*d* and 38*e* to stabilize the support member 4. However, it is preferred that the width of the recesses 38*a*, 38*b*, 38*c*, 38*d* and 38*e* is radially increased as set forth above and that the locking projection is in the shape of a square rod, because the locking projection subjected to the spring force of the compression coil spring 55 can be certainly brought into contact with the slopes of the recesses 38*a*, 38*b*, 38*c*, 38*d* and 38*e*, so that the support member 4 can be certainly engaged and fixed through the locking projection.

In the foregoing embodiment, the angle between the first recess 38*a* and the second recess 38*b*, the angle between the first recess 38*a* and the third recess 38*c*, and the angle between the third recess 38*c* and the fourth recess 38*d* are all θ1 (45 degrees), but these angles between the recesses need not be equal and the angle θ1 need not be 45 degrees.

At least a few of components constituting the handle 2, 102, the housing handle 3, the pivot connection 5 and the locking mechanism 6, 106 may be made of metal such as aluminum or alloy such as aluminum alloy, instead of synthetic resin.

According to the present invention, as has been described hereinabove, the position of the support member to which a cleaning wiper is to be attached can be changed with a simple operation. In addition, the support member can be stabilized in predetermined positions without causing unexpected turn.

The present invention should not be understood as limited to the specific embodiment set out above but to include all possible embodiments which can be embodied within a scope encompassed and equivalent thereof with respect to the feature set out in the appended claims.

What is claimed is:

1. A holding device for a cleaning wiper comprising:

a handle; and a support member pivotally connected to a front end of the handle and configured to support a cleaning wiper, the support member having a pivot axis oriented in a direction crossing a shaft axis of the handle, wherein the support member has sliding surfaces that are formed at a predetermined normal distance from the pivot axis and recesses that are formed toward the pivot axis from the sliding surfaces, the sliding surfaces and the recesses alternating with each other about the pivot axis, the handle has a locking member with a locking projection capable of engaging in the recesses, the locking member being movable along the shaft axis inside the handle, the locking member being provided along with a biasing member configured to apply a biasing force to the locking member toward the recesses and an operating member configured to move the locking member in a direction opposite to the biasing force of the biasing member, the operating member is disposed at the front end of the handle in the vicinity of the pivot axis and is a push button that is externally exposed on an outer periphery of the handle and movable in a direction crossing the shaft axis, the locking member has an inclined sliding surface inclined to both a direction along which the push button is to be pushed and a direction along which the locking member is movable, wherein a sliding component force acting on the inclined sliding surface as the push button is pushed permits the locking member to move against the biasing force of the biasing member, and wherein the locking projection protrudes from the inclined sliding surface.

2. A holding device as set forth in claim 1, wherein the sliding surfaces are formed on an imaginary cylindrical surface drawn with a center at the pivot axis.

3. A holding device as set forth in claim 1, wherein the support member has a cleaning support surface for pressing a cleaning wiper attached thereto against a surface to be cleaned, wherein selective engagement of the locking member in the recesses permits a stepwise change of angle between the shaft axis and the cleaning support surface.

4. A holding device as set forth in claim 1, wherein one of the recesses is a fold locking recess and when the locking member engages in the fold locking recess, the support member is folded back to substantially overlie the handle.

5. A cleaning tool comprising: the holding device of claim 1; and a cleaning wiper to be attached to the support member, wherein the cleaning wiper is a disposable wiper comprising nonwoven fabric, paper or a combination of nonwoven fabric and a bundle of fibers, and the cleaning wiper is supported by the support member with the support member inserted into holding spaces formed in the cleaning wiper.

* * * * *